United States Patent [19]

Stephens et al.

[11] 4,214,902

[45] Jul. 29, 1980

[54] HIGH TOUGHNESS-HIGH STRENGTH IRON ALLOY

[75] Inventors: Joseph R. Stephens, Berea; Walter R. Witzke, Seven Hills, both of Ohio

[73] Assignee: The United States of America as represented by the Administrator of the National Aeronautics and Space Administration, Washington, D.C.

[21] Appl. No.: 7,083

[22] Filed: Jan. 25, 1979

Related U.S. Application Data

[63] Continuation-in-part of Ser. No. 803,822, Jun. 6, 1977, abandoned.

[51] Int. Cl.[2] ..... C22C 39/02

[52] U.S. Cl. ..... 75/124

[58] Field of Search ..... 75/124, 125; 148/31

[56] References Cited

U.S. PATENT DOCUMENTS

| | | | |
|---|---|---|---|
| 2,683,677 | 7/1954 | Walters, Jr. et al. | 75/124 |
| 3,132,938 | 5/1964 | Decker et al. | 148/142 |
| 3,262,777 | 7/1966 | Sadowski | 148/142 |
| 3,284,191 | 11/1966 | Hadrean et al. | 75/124 |
| 3,348,981 | 10/1967 | Godu et al. | 148/142 |
| 3,388,988 | 6/1968 | Nagashima et al. | 148/142 |
| 3,475,164 | 10/1969 | Hadrean | 75/124 |
| 3,514,284 | 5/1970 | Eiselstein et al. | 148/142 |
| 3,836,407 | 9/1974 | Partier et al. | 148/142 |

FOREIGN PATENT DOCUMENTS

| | | | |
|---|---|---|---|
| 1073784 | 6/1967 | United Kingdom | 75/125 |

*Primary Examiner*—M. J. Andrews

*Attorney, Agent, or Firm*—N. T. Musial; J. R. Manning; G. E. Shook

[57] ABSTRACT

An iron alloy is provided which exhibits excellent strength and toughness characteristics at cryogenic temperatures. The alloy consists essentially of about 10 to 16 percent by weight nickel, about 0.1 to 1.0 percent by weight aluminum, and 0 to about 3 percent by weight copper, with the balance being essentially iron. The iron alloy is produced by a process which includes using cold rolling at room temperature and subsequent heat treatment at temperatures ranging from 400° to 650° C., and possesses a fracture toughness ranging from 200 to 230 ksi $\sqrt{\text{in.}}$ and yield strengths up to 230 ksi.

9 Claims, No Drawings

HIGH TOUGHNESS-HIGH STRENGTH IRON ALLOY

ORIGIN OF THE INVENTION

The invention described herein was made by employees of the United States Government and may be manufactured or used by or for the Government without the payment of any royalties thereon or therefor.

STATEMENT OF COPENDENCY

This application is a continuation-in-part of application Ser. No. 803,822 which was filed June 6, 1977 and is now abandoned.

FIELD OF THE INVENTION

This invention relates to an improved iron alloy which exhibits both high toughness and high strength at cryogenic temperatures.

BACKGROUND OF THE INVENTION

Cryogenic pressure vessels and pipes for storing and transporting liquified gases must have high strength and toughness to be able to withstand both thermal and mechanical shocks. Further, alloys with high strength and toughness are also desirable for use in extra-terrestrial applications since the sheet thickness required is reduced, thereby saving both weight and space. It should be noted that data pertaining to the strength and toughness of alloys at room temperature does not necessarily indicate the toughness behavior at lower temperatures and alloys which exhibit high strength characteristics do not necessarily posses correspondingly high toughness.

Attempts have been made in the prior art to produce high strength, high toughness steel alloy capable of use at cryogenic temperatures. A number of examples of such attempts can be found in the patented art. For example, U.S. Pat. No. 3,836,407 (Parker et al) discloses a Fe-12Ni-0.5Ti alloy which is said to be suitable for cryogenic use and to exhibit a Charpy V-Notch toughness value up to about 170 ksi $\sqrt{\text{in.}}$ and a yield strength of about 150 ksi. Moreover, further attempts at producing high strength steel alloys for cryogenic use are disclosed in U.S. Pat. Nos. 3,132,938 (Decker et al) and 3,514,284 (Eiselstein). The former discloses a steel comprising 17 to 19% Ni, 8 to 9% Co, 2.8 to 3.5% Mo, 0.05 to 0.15% Al as well as other elements in small amounts. The latter discloses a nickel-iron alloy which comprises 36 to 42% Ni, Nb and Ta and up to 0.015% Al, with the remainder being Fe and small amounts of other elements. Other patents of interest include U.S. Pat. Nos. 3,348,981 (Goda et al) and 3,388,988 (Nagashima et al). The former discloses an alloy which is said to possess good strength characteristics at low temperatures and which comprises 0.04% to 0.17% A together with Mn. Cr, and C. The alloy disclosed in the Nagashima et al patent is also said to be tough at low temperatures. This alloy comprises 4.5 to 7.5% Ni, together with Al, Mn, Cr, W, Mo and other elements. Also, U.S. Pat. No. 3,338,709 (Baker et al) discloses a high strength steel said to have good toughness which comprises 8 to 10% Ni, 3 to 5% Co, 0.5 to 2.5% Mo, 0.1% Al and other elements. A final patent of interest in U.S. Pat. No. 3,262,777 (Sadowski) which relates to maraging steels using high levels of chromium and molybdenum. The steels disclosed are said to be of high strength and ultra tough. In an example of interest, the steel alloy is composed of 9.5 to 13.5% Ni, 2.5 to 8 Cr, 1.9 to 4.2% Mo, up to 0.75% Al, Ti, Ni and other elements in small amounts. It will be understood that the patents discussed above are exemplary only and that this listing is in no way represented to be exhaustive.

SUMMARY OF THE INVENTION

In accordance with the invention, an improved high strength, high toughness iron alloy is provided which is particularly adapted for use at cryogenic temperatures. The iron alloy of the invention consists essentially of about 10 to 16 percent by weight nickel, about 0.1 to 1.0 percent by weight aluminum, and 0 to about 3 percent by weight copper, with the balance essentially iron. Two embodiments of the invention which possess particularly good characteristics have the compositions Fe-12Ni-0.25Al and Fe-12Ni-0.25Al-2.0 Cu. These alloys exhibit fracture toughness up to 230 ksi in and yield strengths of about 230 ksi.

The alloys of the invention are preferably produced by a process which comprises heating the alloy composition to produce a cast ingot, hot rolling the ingot to produce a sheet, subjecting the sheet to a second rolling operation at a temperature ranging from the temperature of the first hot rolling to room temperature, and annealing the sheet at temperatures ranging from 400° C. to 900° C., followed by water quenching. Heightened toughness and strength characteristics are obtained when the second rolling operation is made at room temperatures, followed by annealing at temperatures in the range of 400° C. to 650° C.

Other features and advantages of the invention will be set forth in, or apparent from, the detailed description of a preferred embodiment found hereinbelow.

DETAILED DESCRIPTION OF THE PREFERRED EMBODIMENTS

As discussed hereinabove, the present invention concerns an Fe-Nk-Al alloy which possesses high strength and high toughness characteristics at cryogenic temperatures. Such very low temperatures are encountered by systems wherein the iron alloys are exposed to liquefied gases or an extra-terrestrial or space environment.

As also was discussed, the alloy composition consists essentially of about 10 to 16 percent by weight nickel, about 0.1 to 1.0 percent by weight aluminum and 0 to about 3 percent by weight copper, with the balance being essentially iron. Preferred compositions of the invention are Fe-12-Ni-0.25Al and Fe-12Ni-0.25Al-2.0 Cu which possess exceptional strength and toughness characteristics at cryogenic temperatures.

The Fe-Ni-Al alloy of the invention is preferably prepared by the process to be described. The process begins with melting high purity starting materials to produce an ingot. To adequately homogenize the ingot, the alloy is given a minimum of four melts. The ingot is hot rolled at 1100° C. after annealing for one-half hour at that temperature. Final rolling can be accomplished over the temperature range from that of the initial hot rolling operation to room temperature. The alloy is then subjected to heating treatment in an argon atmosphere for two hours at temperatures ranging from 400° C. to 900° C. followed by water quenching.

Certain steps in the process described above are extremely important in producing an alloy having optimum properties. In accordance with a preferred embodiment of the process includes final rolling at room temperature (cold rolling) followed by heat treatment at temperatures ranging from 400° to 650° C.

The microstructure of the alloy of the invention is dependent upon the annealing conditions and the amount of the reactive metal aluminum and the additional element copper which are present. For example, toughness in the Fe-12Ni-0.25Al-2.0 Cu composition referred to above is achieved by the additions of nickel and the reactive element aluminum, the aluminum reacting with the interstitial impurities normally contained in iron alloys, while strengthening is achieved by the copper rich precipitates developed in this alloy which range in size from about 100 to 400 Angstroms in diameter.

Microstructural differences can be controlled by the various heat treatments used in the process of this invention. For example, the hot rolling step of the process occurs in the austentite region producing a face-centered-cubic (FCC) arrangement. On cooling this FCC structure transforms to a body-centered-cubic (BCC) structure. The air cooling utilized should be sufficiently slow to produce a microstructure consisting mainly of ferrites with some austenite present. The various annealing temperatures, and the water quenching step which follows, will determine how much of the ferrite structure is transformed to martensite. A higher annealing temperature produces a greater amount of transformed structure.

Measurements have been made to determine the toughness of the iron alloy using the following slow-bend precracked Charpy method. Specimens were oriented longitudinally in the sheet bar with a 45° notch across the thickness. After annealing, each specimen was fatigue cracked to an initial crack length to specimen width ratio of approximately 0.4. Testing was conducted in a three-point bending apparatus immersed in a liquid nitrogen bath or at room temperatures. The specimen was positioned between a 6.35-mm-diameter center roller and two similar rollers that provide a support span of 38.1 mm. A crosshead speed of 1.3 millimeters per minute was used. A load/deflection curve was generated on an X-Y plotter from the outputs of a load cell which supported the bend apparatus and a double cantilever clip-in displacement gage. The gage caused the deflection by means of the vertical movement of a ceramic rod riding on the bend bar. The fracture toughness parameter, K was determined from the load/deflection curve using the relation:

$$K = \frac{SP\sqrt{A_1 1 A_2}\ f(a/w)}{BW\,3/2}$$

where $A_1$ is the area under the curve to the maximum load, $A_2$ is the area under the curve to P, a is the specimen crack depth, B is the specimen thickness, f(a/w) is the value of the power series for the initial crack length to specimen width ratio (a/w), P represents any point on the linear portions of the load/deflection curve, S is the span for the three-point bending, and W is the specimen width.

The methods used herein for measuring toughness and strength of the iron alloy of the invention are standard procedures and should be well known to those skilled in the art.

Specific properties exhibited by the iron alloys of this invention are shown in Table 1 below. The table provides a comparison with a Fe-12Ni-0.5Ti composition as that disclosed in U.S. Pat. No. 3,836,407 (Parker et al) discussed hereinabove. It will be understood that although the process used for the production of the Fe-12Ni-0.5 Ti alloy of the Parker et al patent is different from that of the present invention, a comparison can be made between the elemental composition and the toughness and strength characteristics of the different alloys can be determined.

Table 1 demonstrates the enhanced toughness and strengths of the alloys of this invention, particularly as provided by the preferred embodiments of Fe-12Ni-0.25Al and Fe-12Ni-0.25Al-2 Cu. It should be noted that the Fe-12Ni-0.25Al alloy has also exhibited good weldability. In this regard, a gas-tungsten arc weld was employed to weld this alloy using the same composition as the filler metal. Following a post weld anneal at 550° C., the fracture toughness and strength properties of the weld metal and the heat-effected-zone were equivalent to the base alloy which was heat treated at 550° C., but contained no welds. As can be seen from Table I, the preferred compositions provide yield strengths of up to 230 ksi and fracture toughness in the range of 200 to 230 ksi in. In contrast, the prior art composition exhibits toughness and strength values approaching 172 ksi√in. and 150 ksi, respectively.

As is also evident from Table I, the temperatures at which the alloy is annealed is very important in producing a high strength, high toughness product.

TABLE I

FRACTURE TOUGHNESS AND YIELD STRENGTHS OF VARIOUS Fe-12Ni ALLOYS

| Testing Temperature | −196° C. | | | | | | 25° C. | | | | | |
|---|---|---|---|---|---|---|---|---|---|---|---|---|
| Annealing Temperature | 550° C. | | 685° C. | | 820° C. | | 550° C. | | 685° C. | | 820° C. | |
| | Y.S.[1] | K.[2] | Y.S. | K. | Y.S. | K. | Y.S. | K. | Y.S. | K. | Y.S. | K. |
| Fe-12Ni-0.5Al | 129 | 287 | 128 | 86 | 139 | 57 | 85 | 297 | 86 | 148 | 89 | 134 |
| Fe-12Ni-0.25Al | 130 | 258 | 160 | 216 | 151 | 199 | 88 | 291 | 129 | 171 | 101 | 164 |
| Fe-12Ni-0.12Al | 120 | 227 | 134 | 157 | 126 | 117 | 86 | 325 | 106 | 130 | 99 | 111 |
| Fe-12Ni-0.25Al-2.0Cu | 230* | 200* | 178 | 201 | 155 | 136 | 140 | — | 128 | — | 106 | — |
| Fe-12Ni-0.42Ti | 150 | 55 | 129 | 162 | 117 | 172 | 115 | 171 | 96 | 154 | 97 | 161 |

*Annealing temperatures of 450° C.
[1]Yield strength in ksi
[2]Fracture toughness in ksi in A preferred range for producing optimum results lies between about 400° C. and 650° C., with alloys annealed in this range exhibiting high toughness values corresponding to that given for the 550° C. annealed condition. Testing has also shown that high strength, high toughness characteristics of iron alloys can be temperature dependent, in that the high values exhibited at room temperature may not be retained under cryogenic conditions. This is particularly evident in the Fe-12Ni-0.5Ti alloy annealed at 550° C. where the fracture toughness at 25° C. is 1.71 ksi in. but drops to 55 ksi√in. at −196° C.

Although the invention has been described relative to exemplary embodiments thereof, it will be understood that other variations and modifications can be effected in these embodiments without departing from the scope and spirit of the invention.

What is claimed is:

1. An iron alloy possessing high strength and high toughness characteristics at cryogenic temperatures consisting of about 10 to 16 percent by weight nickel,
about 0.1 to 1.0 percent by weight aluminum,
about 0.5 to about 3 percent by weight copper
the balance being essentially iron.

2. The alloy according to claim 1 wherein the nickel is present in an amount of about 12 to 15 percent.

3. The alloy according to claim 2 wherein the nickel is present in an amount of about 12.5 to 13.5 percent.

4. The alloy according to claim 3 wherein the aluminum is present in an amount of about 0.25 percent.

5. The alloy according to claim 4 wherein the copper is present in an amount of about 2 percent.

6. The alloy according to claim 3 wherein the copper is present in an amount of about 1.8 to 2.2 percent.

7. The alloy according to claim 1 wherein the aluminum is present in an amount of about 0.2 to 0.5 percent.

8. The alloy according to claim 7 wherein the aluminum is present in an amount of about 0.25 percent.

9. The alloy according to claim 1 wherein the copper is present in an amount of about 1.8 to 2.2 percent.

* * * * *